US005529507A

United States Patent [19]

Felix et al.

[11] Patent Number: 5,529,507

[45] Date of Patent: Jun. 25, 1996

[54] CONNECTOR ASSEMBLY HAVING DOUBLE ENDED SHORTING CLIP

[75] Inventors: Steven D. Felix, Russiaville, Ind.; Joseph H. Gladd, Cortland; Randy L. Fink, Warren, both of Ohio

[73] Assignee: General Motors Corporation, Detroit, Mich.

[21] Appl. No.: 369,949

[22] Filed: Jan. 9, 1995

[51] Int. Cl.[6] ..... H01R 13/703

[52] U.S. Cl. ..... 439/188; 439/594

[58] Field of Search ..... 439/507, 511, 439/512, 513, 188, 592–594; 200/51.09, 51.1

[56] References Cited

U.S. PATENT DOCUMENTS

| | | | |
|---|---|---|---|
| 3,869,191 | 3/1975 | Tolnar, Jr. et al. | 439/186 |
| 4,448,477 | 5/1984 | Gladd et al. | 439/851 |
| 4,850,888 | 7/1989 | Denlinger et al. | 439/188 |
| 4,906,203 | 3/1990 | Margrave et al. | 439/188 |
| 4,978,311 | 12/1990 | Oda et al. | 439/188 |
| 5,295,846 | 3/1994 | Sumida et al. | 439/188 |

*Primary Examiner*—Hien D. Vu

*Attorney, Agent, or Firm*—Cary W. Brooks; William A. Schuetz

[57] ABSTRACT

An electrical connector assembly has a pair of mating connector housings carrying mating metal terminals, a double ended shorting clip carried by one of the housings and having both ends thereof in spring biased engagement with its associated metal terminals in that housing and a connector position assurance member. The shorting clip first has one end automatically disengaged from its associated metal terminals by a first cam when the connector housings are mated together and then its other end automatically disengaged from its associated terminals by a second cam on the connector position assurance member when connected to the mated housings so that a shorting path across the associated metal terminals is only fully disconnected if proper mating of the connector housings is assured.

5 Claims, 3 Drawing Sheets

CONNECTOR ASSEMBLY HAVING DOUBLE ENDED SHORTING CLIP

FIELD OF THE INVENTION

This invention relates to electrical connectors.

BACKGROUND OF THE INVENTION

The present invention relates to an electrical connector assembly having a shorting clip, and, in particular, to an electrical connector assembly comprising a pair of mating connector subassemblies and in which a double ended shorting clip is first automatically disengaged at one end from its associated metal terminals in one of the connector subassemblies to break a first shorting path when the mating connector subassemblies are connected together and thereafter is automatically disconnected at its other end from the associated metal terminals to break a second shorting path by a connector position assurance member so that the second shorting path across the metal terminals cannot be disconnected unless the mating connector subassemblies have been properly connected together.

In the handling of electrically energizable charges or igniters, it is common practice to provide a short across the wires or leads connected to the charge or igniter prior to the usage thereof. The short eliminates the possibility of static electricity or RF interference from generating a current flow or voltage drop across the leads which could produce premature accidental actuation of the charge or igniter. It is also known to employ an electrical connector means comprising mating connector subassemblies in which one has a shorting means in the form of a spring clip which is self biased toward a position in which it engages its associated terminals to provide a bussing shunt across the terminals when the connector subassemblies are disconnected and in which the other connector subassembly includes a cam means which engages the spring biased shorting clip to automatically disengage the shorting clip from its associated terminals subsequent to the mating terminals of the connector subassemblies engaging one another. In this arrangement the respective terminals of the connector subassemblies are first engaged with each other prior to the cam means of other connector subassembly disengaging the shorting means from its associated terminals of the one connector subassembly. Such an arrangement is shown in U.S. Pat. No. 3,869,191, which patent is assigned to the same assignee as the present invention.

SUMMARY OF THE INVENTION

The present invention provides a new and improved electrical connector assembly of the above-noted type. Although the electrical connector assembly of the present invention could be used in various applications wherein it is desired to automatically provide for bussing of terminals of a connector assembly connected to an electrically energizable device when its two mating subassemblies are disconnected, it is particularly susceptible for use with an inflatable cushion restraint system having a squib for igniting a charge to burst a diaphragm for controlling communication between a pressure vessel and an inflatable bag and/or having an electrical igniter means for energizing gas generators located within the pressure vessel.

The novel connector assembly of the present invention when used in an inflatable cushion restraint system has one connector subassembly provided with a shorting means for bussing its associated terminals. This connector subassembly is adapted to be electrically connected via conductors to a squib for a charge and/or electrically energizing igniter means for a gas generator or generators. The other connector subassembly is connected in a circuit with a controller or control means including sensor switches for actuating the restraint system when predetermined conditions are present. The provision of the shorting clips for bussing the various terminals of its associated connector subassembly enables the various components of the air cushion restraint system to be assembled in an automotive vehicle without any premature or accidental actuation of the system due to static electricity, RF interference, etc.

It is also common practice in the art to provide a connector position assurance member to make sure that two mating connector subassemblies or housings have been properly mated-together. The connector position assurance member cannot be connected to the mated connector subassemblies or housings if they are not properly mated or they are disconnected. It can only be secured to the two subassemblies if they are properly mated.

Accordingly, an important feature of the present invention is to provide a new and improved electrical connector assembly of the above noted type and in which the shorting means carried by one of the connector subassemblies is in the form of a shorting spring clip which is self biased toward a position in which it engages its associated terminals so as to automatically provide for bussing across the terminals when the connector subassemblies are disconnected, and in which the connector assembly includes a connector position assurance member for assuring that the connector subassemblies have been properly mated together and in which the connector position assurance member includes a cam means thereon which engages the shorting clip to automatically disengage the shorting clip from its associated terminals only if the connector subassemblies have been properly mated or connected together.

Another more specific feature of the present invention is to provide a new and improved electrical connector assembly comprising a pair of mating connector housings having a plurality of spaced metal terminals therein which are adapted to mate with each other when the connector subassemblies are connected together, and in which one of the connector subassemblies includes a shorting clip having spring fingers at its opposite ends which are self biased toward a position in which they engage associated metal terminals at two spaced locations thereon when the connector subassemblies are disconnected to provide two shorting paths thereacross to prevent premature accidental actuation of an electrically actuated device operatively connected with the terminals and in which the other of the connector subassemblies includes a cam means which functions to move the spring fingers at one end of the shorting clip in opposition to its self biasing force to disengage it from its associated terminals subsequent to the mating terminals of the connector subassemblies engaging one another. The connector assembly further includes a connector position assurance member slidable on one of the connector subassemblies and connectable to the other subassembly for assuring that the subassemblies have been properly mated together and in which the connector position assurance member also includes a cam means for engaging the other fingers at the other end of the shorting clip to disengage them from the associated metal terminals when being slid and then connected to the other connector subassembly whereby the connector position assurance member provides the dual function of assuring that the mating connector subassemblies have been properly mated together and ensures that the shorting clip will not be disengaged from its associated terminals unless the connector subassemblies have been properly mated together.

The advantages of the novel electrical connector assembly of the present invention are that it is of a relatively economical and simple construction, that the connector subassemblies can be readily, properly connected together, that their proper connection can be assured, and that the dual bussing paths cannot be interrupted until the connector subassemblies of the connector assembly have been properly mated together.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which:

DETAILED DESCRIPTION

Figure 3:
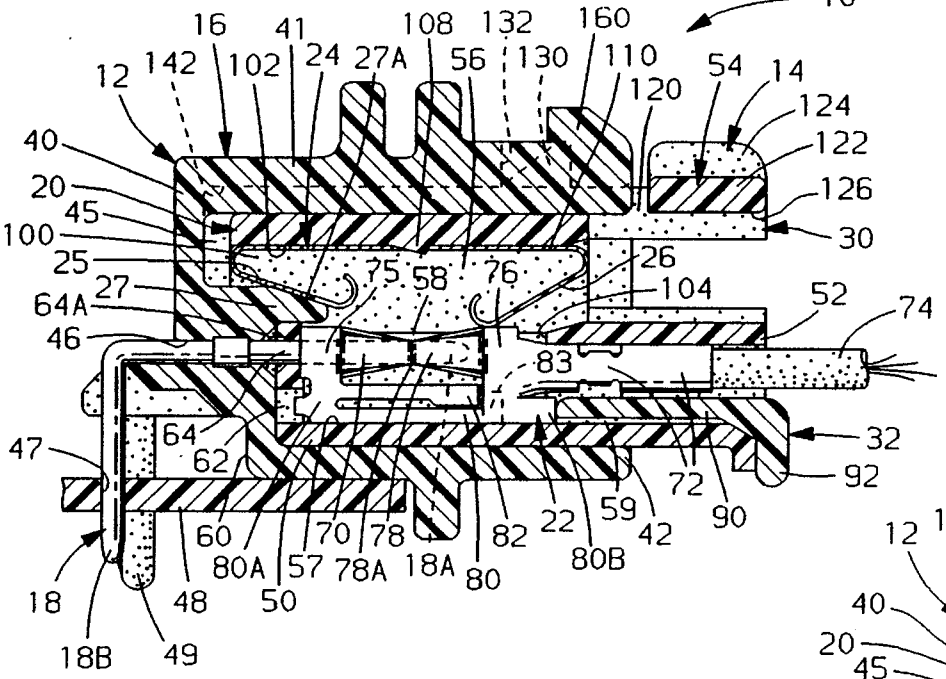
FIG. 3 is an enlarged axial cross sectional view like that shown in FIG. 2, but showing the parts connected to one another.

Referring to the drawings, the novel electrical connector assembly 10 of the present invention comprises, in general, a pair of mating connector subassemblies 12 and 14. The connector subassembly 12 comprises a male insulator housing 16 which carries a plurality of laterally spaced, cylindrical, male pin terminals 18 therein. The connector subassembly 14 comprises a female insulator housing 20 for carrying a plurality of laterally spaced female socket terminals 22 therein. The female connector assembly 14 also carries a shorting clip 24 having pairs of spring fingers 25, 26 which are self biased towards a position in which they engage the adjacent female terminals 22 at spaced longitudinal locations to provide a pair of shunting paths thereacross when the connector assemblies 12, 14 are disconnected from one another. The male connector housing 16 has a cam means 27 which functions to engage the fingers 25 of the shorting clip 24 to disengage them from the female terminals 22 subsequent to the female terminals 22 engaging the male terminals 18 when the connector housings 16, 20 are connected together. The connector subassemblies 12, 14 are retained in their mated or engaged position, as shown in FIG. 3, by a latching means 30.

Figure 4:
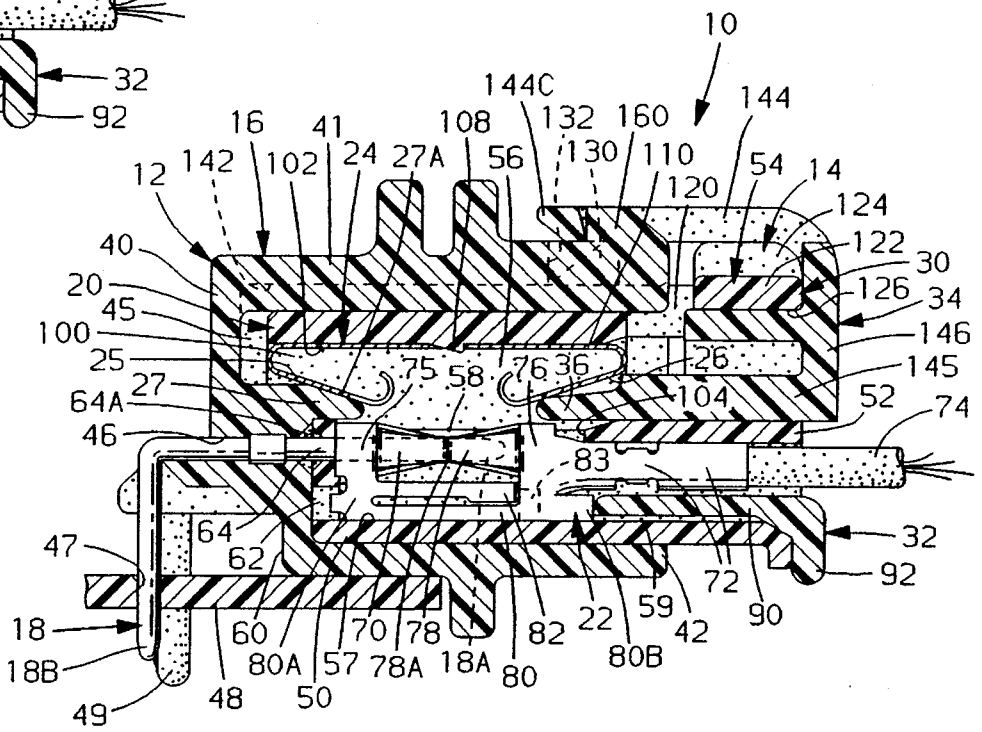
FIG. 4 is an enlarged axial cross sectional view like that shown in FIG. 3, but showing all of the parts of the connector assembly connected together.

The connector assembly 10 also includes a terminal position assurance member (TPA) 32 which is slidably connected to the female insulator housing 20 for assuring that the female terminals 22 are all properly seated or positioned within the insulator housing 20 and a connector position assurance member (CPA) 34 for assuring that the connector subassemblies 12, 14 have been properly connected together. The connector position assurance member (CPA) 34 includes a cam means 36 which is engageable with the spring fingers 26 of the shorting clip 24 to disengage the same from their associated adjacent female terminals 22 when it is locked to the connector subassembly 12, as shown in FIG. 4. The connector position assurance member 34 serves the dual purpose of assuring that the mating connector subassemblies 12, 14 have been properly connected together and for assuring that the shorting path or circuit across the terminals 22 cannot be broken unless the mating connector assemblies 12, 14 have been properly connected together.

Figure 2:
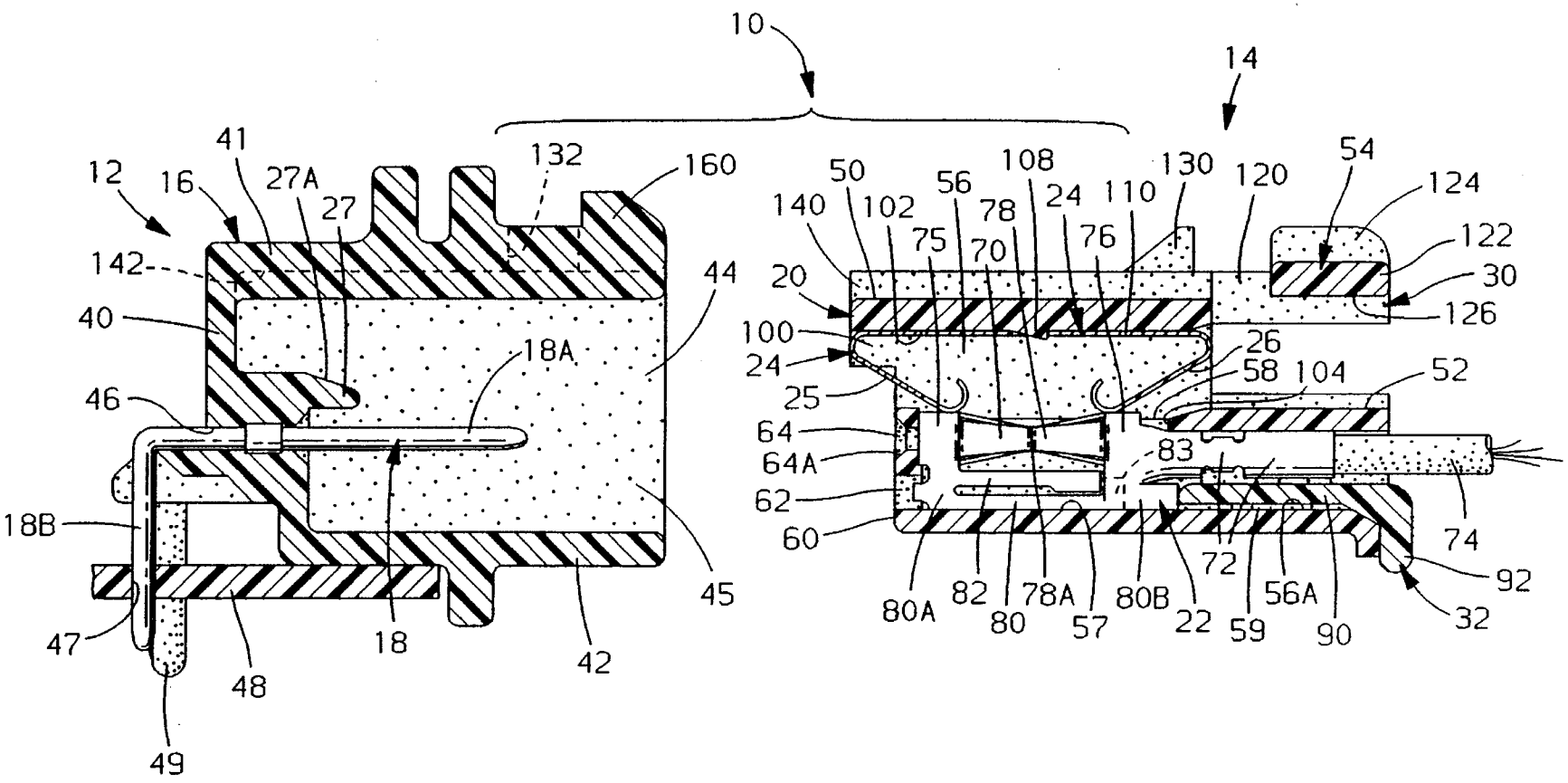
FIG. 2 is an enlarged axial cross sectional view of certain parts of the novel electrical connector assembly shown in FIG. 1.

The male insulator housing or body 16 of the connector subassembly 12 is made from a suitable dielectric material, preferably plastic, and is of a generally rectangular shape. The insulator housing 16 is in the form of a header housing having an end wall 40, a top wall 41, a bottom wall 42 and a pair of side walls 43, 44, which together define a central cavity 45. The end wall 40 has a plurality of laterally spaced through openings 46 for receiving the male pin terminals 18. The male pin terminals 18 (only one of which is shown in FIGS. 2–4) are aligned in a row and have forward end portions 18A which project into the cavity 45 and have rearward end portions 18B which are bent at right angles to the forward portions 18A and which extend through openings 47 on a printed circuit board 48. The end portions 18B are adapted to be connected or soldered to printed circuit traces (not shown) on the printed circuit board 48. The male pin terminals 18 are retained within the end wall 40 of the insulator housing 16 via a press fit and in a manner conventional in the art. The male insulator housing 16 also includes a pair of barbed projections 49 integral with but located rearwardly of the end wall 40. The projections 49 are snap fittingly pushed through suitable openings (not shown) in the printed circuit board 48 to attach the insulator housing 16 to the printed circuit board 48. Alternately, the housing 16 could have a pair of legs which could be bolted to the printed circuit board.

The male insulator housing 16 also includes the forwardly projecting cam means 27 in the form of three laterally spaced cams which are integral with the end wall 40 and project in a direction parallel to the forward portions 18A of the male pin terminals 18, the cams 27 extending within the cavity 45, as shown in FIG. 2. The cams 27 also have a tapered upper surface, as indicated at 27A, to define a cam whose thickness progressively decreases from its end adjacent the end wall 40 towards its free end, as shown in FIG. 2.

The connector subassembly 14 comprises the insulated connector housing 20 which is made from a suitable dielectric material, such as plastic, and is of a generally rectangular shape complementary to that of the connector subassembly 12. The female connector housing 20 has a main or forward body portion 50, a rearward deck portion 52 and a pump handle latch member 54. The forward body portion 50 has a plurality of laterally spaced cavities or longitudinally extending openings 56 therethrough for receiving the female terminals 22. The cavities 56 have a planar bottom 57 and are separated from each other by vertically extending walls 58 which extend from a forward end wall 60 at the forward body portion 50 to the deck portion 52. The walls 58 along a rearward section of the forward body portion 50 are spaced from the bottom 57 of the cavities 56 so that the cavities 56 all communicate with a rectangularly shaped cavity 59 extending across a rearward section of the forward body portion 50 of the housing 20 at its bottom 57. The cavity 59 is adapted to slidably receive the terminal position assurance member 32, as will be hereinafter more fully described. The forward end wall 60 includes pairs of vertically spaced openings 62, 64 therein which are aligned with and in communication with the cavities 56. The openings 64 have a tapered entry end 64A.

The longitudinally extending cavities 56 are adapted to receive the female socket terminals 22. The female socket terminals 22 could be of any suitable or conventional construction, but are preferably of the type shown and described in U.S. Pat. No. 4,448,477, issued May 15, 1984, and assigned to the same assignee as the present invention. Since resort may be had to the aforementioned U.S. Pat. No. 4,448,477 for a complete description of the female socket terminals 22, the socket terminals 22 will only be herein described to the extent necessary for an understanding of the present invention.

The socket terminals 22 have an elongated resilient socket 70 at one end and a conductor attachment 72 at its other end comprising conventional conductor core and insulation crimp barrels for attachment to the core and insulation of a suitable cable or insulated conductor 74. The socket 70 comprises a pair of axially spaced, split tubes 75, 76 which are joined by a circumferentially spaced array of juxtaposed spring strips 78. The split tubes 75, 76 are rectangular in shape and the circumferential array of juxtaposed spring strips 78 consists of four spring strips which are integral at each end with their respective sides of the rectangularly shaped split tubes 75, 76. The spring strips 78 taper inwardly from each end, as shown in FIG. 2, to provide contacts at their narrowest width 78A for biasingly engaging the cylindrical pin terminals 18 which are adapted to be inserted therein, as in a manner to be hereinafter more fully described. The socket terminal 22 further includes a retaining means comprising a U-shaped guard 80 and a resilient latch tang 82. The U-shaped guard has axially spaced legs 80A, 80B which are integral with the respective split tubes 75, 76 and the resilient latch tang 82 is integral with one end to the leg 80A of the U-shape guard 80 and extends generally axially of the elongated resilient socket 70. The socket terminals 22 are connected to the insulator body by inserting the same into the cavities 56 from right to left, as viewed in FIG. 2. The leg portions 80A and 80B of the U-shaped guard 80 slide along the bottom walls 57 of the cavities 56. The latch tang 82 is adapted to engage an abutment 83 integral with and extending transversely of the vertical wall 58 into the cavity 56 and be deflected until the female terminal 22 is moved all the way into engagement with the forward end wall 60 whereupon the latch tang 82 will return to its normal free state position and latch behind the abutment 83 to prevent reverse movement of the socket terminal 22. The socket terminal 22 engages the forward end wall 60 to prevent over-insertion of the same into the cavity 56. The reason for the provisions of the openings 62 is to allow a suitable tool to be inserted through the openings 62 to unlatch the latch tang 82 should a need arise for the terminal 22 to be replaced. Also in this position, the socket 70 of each socket terminal 22 is aligned with the upper opening 64 to receive a mating pin 18 when connected to the connector housing 12.

Figure 1:
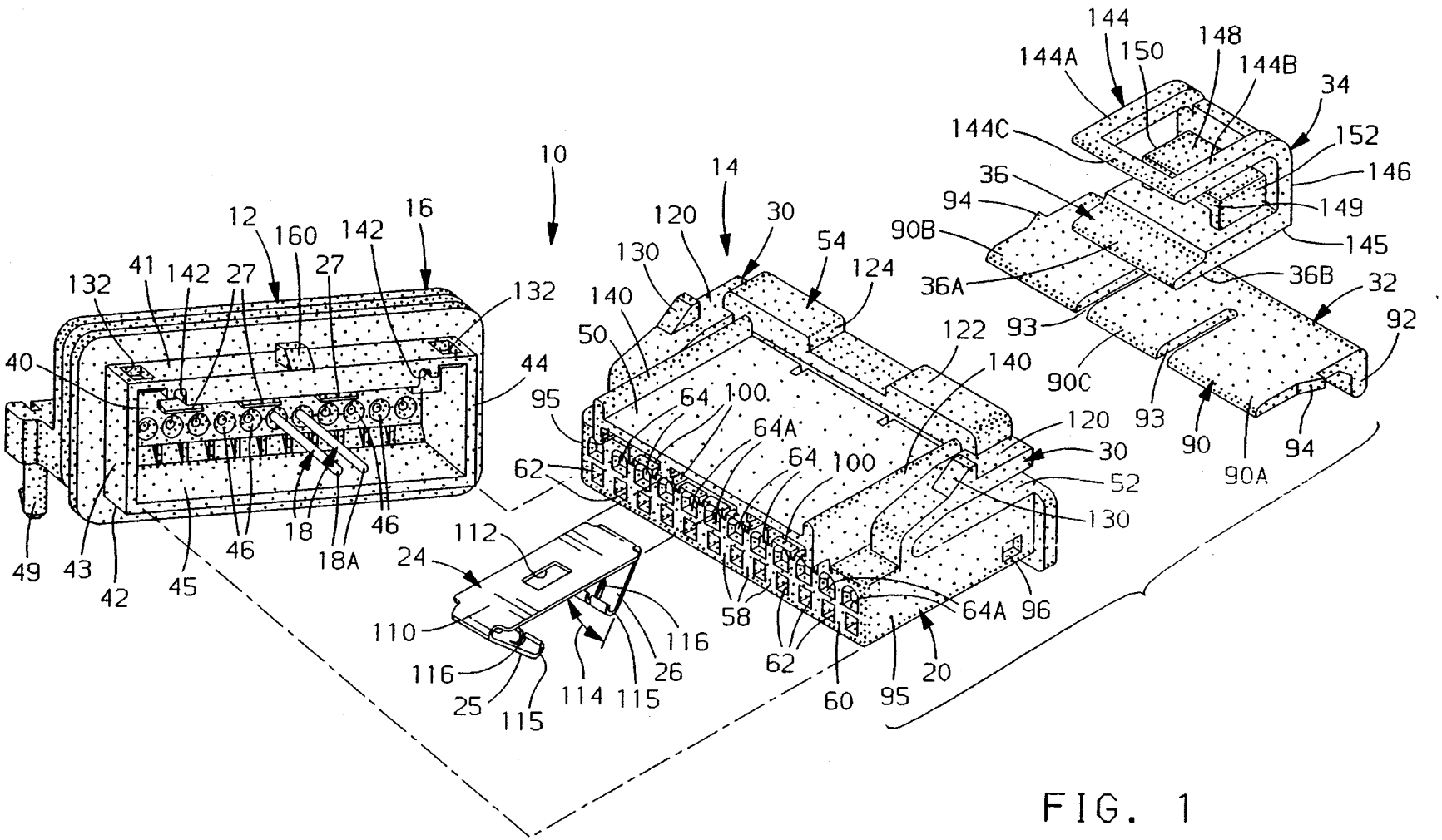
Fig. 1 is an exploded perspective view of most of the parts of the novel electrical connector assembly of the present invention.

When all the female socket terminals 22 have been connected to the insulator housing 20, the terminal position assurance member 32 is employed to assure that each of the terminals 22 has been properly located within its respective cavity 56. The terminal position assurance member 32 comprises a flat plastic member 90 having a downwardly extending flange 92 at one end so as to enable the same to be manually grasped. In addition, the member 90 includes a pair of laterally spaced slots 93 and has a laterally extending latch or ramp 94 at each of its sides. The terminal position assurance member 32 is slidably received in the cavity 59 between the bottom edge of the walls 58 and the bottom wall 57 of the housing 20, and with the forward end of the terminal position assurance member 32 engaging the rearward legs 80B of the terminals 22 to assure that they have all been properly positioned within the cavities 56 and connected to the housing 20. The latches 94 are adapted to engage the interior sides of the side walls 95 of the forward portion 50 of the connector housing 20 until they are located adjacent a pair of openings 96 in the side walls 95. As best shown in FIG. 1, the flat member 90 of the terminal position assurance member 32 at its right and left end portions 90A, 90B is deflectable toward the center portion 90C thereof due to the provision of the slots 93 so as to enable the same to be slid within the front portion 50 of the insulator housing 20 until the latches 94 are aligned with the openings 96 whereupon, due to the inherent resiliency of the end portions 90A, 90B, they spring back to their normal free state position and snap into place within the openings 96.

The insulator body 20 also houses the shorting clip 24 which is adapted to engage the axially split tubes 75, 76 of adjacent terminals 22 when the insulator body 20 is disconnected from the insulator body 16 of the connector subassembly 12. To this end, the insulator body 20 has three laterally spaced cavities 100 extending axially therethrough and which are located directly above the cavities 56 containing the female socket terminals 22. Although only one shorting clip 24 is shown in the drawings and described herein, up to three shorting clips 24 could be employed, one for each cavity 100. The cavities 100 have a planar upper inner wall surface 102 extending the full axial length of the main or forward body portion 50 and are in communication with and adjacent a pair of the cavities 56 located therebeneath via slots 104. The upper wall 102 of each of the cavities 100 also includes an integral downwardly extending tapered nib or protrusion 108 which extends laterally inwardly into the cavity 100.

As best shown in FIGS. 1 and 2, the shorting clip 24 is double ended and includes a planar main or bridge portion 110 having a central cut out 112. A shorting clip 24 also includes pairs of spring fingers 25, 26 which are integral with the bridge portion 110 at its opposite forward and rearward ends, or left and right ends, as viewed in the drawings. The fingers 25, 26 are reversely bent or curled underneath the bridge portion 110 and extend towards each other. The spring fingers 25, 26 form an acute included angle 114 with the bridge portion 110 and they have curled ends 115. The spring fingers 25, 26 of each pair are separated by slots 116 to provide a pair of laterally spaced fingers 25, 26, as best shown in FIG. 1. The slots 116 receive a common vertical wall 58 between the adjacent cavities 56 and allows the curled ends 115 of the spring fingers 25, 26 and to extend downwardly into the adjacent cavities 56 to engage the axially split tubes 75, 76 of the female socket terminal 22 located therein. The spring fingers 25, 26 of each pair of spring fingers thus engages adjacent terminals 22 located in adjacent cavities 56 to provide a shunt across the adjacent terminals 22 when the subassembly 14 is disconnected from the subassembly 12.

The shorting clip 24 is connected to the female connector housing 20 by inserting the same from left to right, as viewed in FIGS. 2–4 of the drawings. When the shorting clip 24 is inserted into the cavity 100, the bridge portion 110 will engage the inwardly extending nib 108 and be deflected downwardly toward the female terminal 22. During this movement, first the spring fingers 26 and then the spring fingers 25 will engage the female terminal 22 and ride thereover. Engagement between the spring fingers 25, 26 and the female terminal 22 will cause a spring biasing force to be exerted against the bridge portion 110 as it is being slid over the nib 108. When the cut out 112 in the shorting clip 24 is aligned with the nib 108, the biasing force of the spring fingers 25, 26 will move the bridge portion 110 into engagement with the planar inner wall 102 of the insulator housing 20 and the shorting clip will be locked against reverse movement. When the shorting clip 24 is connected to the insulator housing 20, the curled ends 115 of each pair of spring fingers 25, 26 will engage the axially split tubes 75, 76 of adjacent female terminals 22 to provide a dual shunt across the adjacent pair of terminals 22 to prevent premature actuation of the restraint system.

The pump handle latch member 54 is integral with the connector housing 20 and includes a pair of spaced, rearwardly extending arms 120 and a transversely extending bridge or handle portion 122. The arms 120 are integrally formed at their forward ends to the main or forward body portion 50 of the housing 20 and extend upwardly and rearwardly of the housing 20 in cantilever fashion. The bridge portion 122 is integral with the arms 120 at their rearward ends, as viewed in FIG. 1. The bridge portion 122 can be manually engaged to depress the latch member 54 toward the housing 20 in opposition to its inherent, resilient self biasing force tending to bias the same to the position shown in FIG. 1, which is its normal free state position. The bridge portion 122 has a central recess 124 on its upper side and has an underside 126 which is spaced from the rear deck 52 of the insulator housing, and for reasons to be hereinafter more fully described. The latch arms 120 also include an upwardly extending tapered latch 130 to enable it to be latched in a catch 132 in the connector housing 16. The catches 132 comprise a pair of laterally spaced openings in the upper wall 41 of the insulator housing 16. In addition, the insulator housing 20 includes a pair of laterally spaced, axially and upwardly extending ribs 140 which are adapted to be received within a pair of axially extending grooves 142 in the upper wall 41 of the connector housing 16 to guide the insulator housing 20 into the insulator housing 16 when being connected thereto and to prevent upside down or improper insertion of the connector housing 20 into the connector housing 16.

When the terminals 22 have all been assembled to the female insulator housing 20, the terminal position assurance member 32 has been inserted into the housing 20 and behind the terminals 22 to ensure that they have all been properly seated within the insulator housing 20, and the shorting clips 24 have been inserted into the cavities 100 in the connector housing 20 and seated therein, the connector subassembly 14 can then be connected to the connector subassembly 12. This is accomplished by inserting the main or forward body portion 50 of the insulator housing 20 into the cavity 45 of the insulator housing 16. The insulator housing 20 can only be inserted if it is properly oriented relative to the insulator housing 16 due to the provision of the ribs 140 which have to be slidably received within the grooves 142 in the insulator housing 16. As the insulator housing 20 is slid into the insulator housing 16, the tapered latches 130 will engage the upper wall 41 of the insulator housing 16 and cause the arms 120 to be deflected downwardly until the latches 130 are aligned with the openings 132 in the housing 16 whereupon the latch member 54, due to its inherent resiliency, will return toward its normal free state position, and the latches 130 will be received within the openings 132 to lock the insulator housing 20 to the insulator housing 16. To disconnect the housing 20 from the housing 16, the latch member 54 can be depressed to disengage the latches 130 from the openings 132 and the housings 16, 20 then pulled apart.

Also, as the connector housings 16, 20 are being connected together, the pin terminals 18 will be guided via the tapered entry ends 64A through the openings 64 in the end wall 60 of the connector body 20 and be received in the socket terminals 22. The pin terminals 18 deflect and biasingly engage the strips 78 of the socket terminals 22 when received therein.

It should further be noted at this point that the insulator housing 16 includes the three laterally spaced cam members 27 which project inwardly into the cavity 45 from the end wall 40 thereof and which are aligned with the cavities 100 in the insulator housing 20. The cam members 27 are tapered, as indicated by reference numeral 27A, so as to have progressively decreasing thickness preceding from the wall 40 to their free ends. The purpose of each of the cam members 27 is that as the connector housing 20 is connected to the connector housing 16, it will engage beneath the ends 115 of the spring fingers 25 and cause the spring fingers 25 to be deflected upwardly in opposition to their self biasing forces and be disengaged from the split tubes 75 of the adjacent terminals 22, as shown in FIG. 3. However, while the cam 27 disengages the spring fingers 25 from the split tubes 75, note that the spring fingers 26 still remain in engagement with the split tubes 76 of the terminals 22 to continue a shunt across adjacently located terminals 22.

To prevent the latch member 54 from being depressed and the connector subassembly 14 from being disconnected from the connector subassembly 12 and to ensure that they have been properly mated or connected together, a connector position assurance member (CPA) 34 is provided. The connector position assurance member 34 is generally U-shaped, and has spaced upper and lower planar sides 144, 145 and an intermediate bottom or bight 146. The upper side 144 is deflectable and is bifurcated to define a pair of laterally spaced arms 144A, 144B integral at one end with the bight 146 and having a transversely extending bridge 144C at its other or free end. The other side 145 has an integral forwardly extending tapered cam means or cam projection 36 whose thickness progressively decreases from its end integral with the side 145 to its free end 36A. The cam projection 36 has a planar bottom side 36B. The connector position assurance member 34 also has an inverted U-shaped abutment 148 integral with the inner side wall surfaces of the bight 146 and the lower side 145. The abutment 148 defines a forwardly facing stop surface 149 and a pair of side rails 150, 152.

The connector position assurance member 34 is adapted to be connected to the connected subassemblies 12, 14 by sliding the same axially along the top of the deck 52 of the housing 20 of the subassembly 14 from right to left, as viewed in FIGS. 3 and 4. As the member 34 is slid, the bridge 144C of the top side 144 will pass through the recess 124 of the latch member 54 and engage a tapered latch 160 extending upwardly and outwardly of the top wall 41 on the housing 16. The tapered latch 160 causes the side 144 to be deflected upwardly until the bridge 144C clears the latch 160 whereupon the side 144, due to its inherent resiliency will return toward its normal free state position and have its bridge 144C lock behind the latch 160, as shown in FIG. 4. The recess 124 prevents lateral shifting of the member 34.

When the connector position assurance member 34 is slid from right to left on the insulator body 20, the lower side 145 and the abutment 148 will be received beneath the bridge portion 122 of the deflectable latch member 54. This prevents the latch member 54 from being deflected downwardly to disengage the latches 130 from the catches 132. If the latch member 54 is not in its normal free state position and properly latched to the connector housing 16, it will be deflected downwardly toward the deck 52 and the forward stop surface 149 of the abutment 148 will engage the bridge portion 122 and prevent the connector position assurance member 34 from being connectable to the latch 160 of the insulator housing 16.

Further, during the sliding movement of the connector positions assurance member 34, the cam 36 performs an important function in that it engages the spring fingers 26 of the shorting clip 24 and causes the same to be disengaged from their associated split tubes 76 of the adjacent female terminals 22, as shown in FIG. 4. It should thus be apparent that the connector position assurance member 34 provides the dual function of assuring that the connector housing 20 or subassembly 14 has been properly connected or mated to the connector housing 16 or subassembly 12 so that the spring fingers 25 of the shorting clip 24 are disengaged from their associated female socket terminals 22 and to provide the additional function of lifting spring fingers 26 from the same associated terminals 22 only if it can be latched to the insulator housing 16 of the subassembly 12. This absolutely ensures that an accidental actuation of a restraint system cannot occur until the connector subassemblies 12, 14 are properly connected to each other and until the connector position assurance member has been properly connected to the connector subassembly 12.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. An electrical connector assembly comprising:

a female insulator connector housing, a male insulator connector housing, a shorting spring clip and a connector position assurance member;

said female connector housing having a planar bottom wall, a front end wall, two side walls, and an inner wall each vertically extending from the bottom wall; and a forward body portion extending in a rearward direction from the front end wall, said front end wall having a plurality of first and second laterally spaced apart openings, each opening for receiving a male terminal, and a slot overlying and traversing said first and second openings and constructed and arranged to receive said shorting spring clip therethrough into a third cavity, said bottom and inner walls defining first and second laterally spaced apart cavities, each of said first and second cavities having a metal female terminal received therein and communicating with a respective opening in the front end wall, each of said female terminals having first and second ends, said third cavity being defined by said front end wall and said forward body portion and being above said first and second cavities;

said spring clip having a bridge portion and first and second spaced apart fingers downwardly extending from one end of the bridge and third and fourth spaced apart fingers downwardly extending from the other end of the bridge, said spring clip being received in said third cavity so that said first and second fingers each are biased downward toward the first end of a respective female terminal and for engagement therewith in a first portion, and said third and fourth fingers each being biased downward toward the second end of a respective female terminal and engagement therewith in a first position;

said male insulator connector housing having first and second holes formed therein and first and second male terminals extending respectively through said first and second holes; said male terminals positioned to be received in said female terminals carried in the female housing, said male and female housings each having a latch element constructed and arranged to latch the housings together when they are fully mated to each other;

a connector position assurance member arranged to sandwich a rear end of said forward body portion and guided for linear sliding movement on said female insulator connector housing, said connector position assurance member having a latch thereon and so that said connector position assurance member is lockable to said male insulator connector housing if the male and female connector housings and their respective terminals have been properly mated together, said connector position assurance member not being lockable to said male connector housing if the male and female connector housings have not been properly mated;

a cam on said connector position assurance member for engaging said first and second fingers of said spring clip and moving said first and second fingers to a second position out of engagement with said female terminals to interrupt a shorting path when said connector position assurance member is locked to said male housing whereby said connector position assurance member functions to prevent disengagement of the spring clip from said metal female terminals until the connector position assurance member has assured that the male and female connector insulator housings have been properly connected together.

2. An electrical connector assembly as set forth in claim 1 further comprising a cam on said male connector housing constructed and arranged to extend through said slot formed in said front wall and to engage said third and fourth fingers and moving said third and fourth fingers to a second position out of engagement with said female terminals.

3. An electrical connector assembly as in claim 1 wherein said female connector housing has an elongated gap underneath said rear end of the forward body portion constructed and arranged so that said rear end is sufficiently deflectable to selectively unlatch said latch elements on said male and female connector housings.

4. An electrical connector assembly as set forth in claim 3 further comprising a terminal position assurance member slidably received in an opening in the rear end of the female housing and constructed and arranged to assure the female terminals are properly positioned in their respective cavities.

5. An electrical connector assembly as set forth in claim 1 wherein an under face of the forward body portion has a nub formed thereon and said spring clip has a hole formed therein sufficient to frictionally receive said nub and secured said spring clip to said forward body portion in said third cavity.

* * * * *